US007410325B1

(12) United States Patent
Nelson et al.

(10) Patent No.: US 7,410,325 B1
(45) Date of Patent: Aug. 12, 2008

(54) MODULAR GUIDE FRAME FOR A GATE

(76) Inventors: Joseph L. Nelson, 29497 205th Ave., Columbus, NE (US) 68601; Ervin T. Engel, III, 2002 S. 70th Ave., Columbus, NE (US) 68601; Daniel M. Fuchs, 1319 8th St., Columbus, NE (US) 68601

( * ) Notice: Subject to any disclaimer, the term of this patent is extended or adjusted under 35 U.S.C. 154(b) by 617 days.

(21) Appl. No.: 11/150,541

(22) Filed: Jun. 10, 2005

(51) Int. Cl.
*E02B 7/26* (2006.01)
*E02B 7/00* (2006.01)

(52) U.S. Cl. ..... 405/104; 405/87

(58) Field of Classification Search ..... 52/202, 52/204.1, 204.2, 205–207, 210–217, 396.05, 52/653.1, 656.2, 657.7, 704, 710; 49/466, 49/504; 105/203; 109/73, 75, 77; 277/641, 277/910; 405/87, 88, 89, 90, 103, 104, 105
See application file for complete search history.

(56) References Cited

U.S. PATENT DOCUMENTS 1,562,113 A * 11/1925 Meyer ..... 405/104
4,439,061 A * 3/1984 Whipps ..... 405/104
4,934,868 A * 6/1990 Hellstrom et al. ..... 405/104
5,077,945 A * 1/1992 Koeniger ..... 52/169.14
5,460,462 A * 10/1995 Regan ..... 405/96
6,623,210 B2 * 9/2003 Nomura et al. ..... 405/107
7,033,112 B2 * 4/2006 Rijlaarsdam ..... 405/87
2002/0078641 A1 * 6/2002 Procton et al. ..... 52/204.1
2005/0163570 A1 * 7/2005 Cullen ..... 405/87

FOREIGN PATENT DOCUMENTS

GB 2180614 A * 4/1987

* cited by examiner

*Primary Examiner*—Robert Canfield
*Assistant Examiner*—John M Frega
(74) *Attorney, Agent, or Firm*—Thomte Patent Law Office; Dennis L. Thomte

(57) ABSTRACT

A modular guide frame for use with gates of various thicknesses is assembled from separate side portions. The side portions are provided with hubs, having facets of different widths. The hubs may be coupled with one another to align the facets and provide different gate guide configurations, having various channel widths. An extension plate may be coupled between the side portions to further expand the width of the channel. Elongated sealing members may be secured within the channel to further customize the fit between the guide frame and a gate. The symmetrical nature of the side portions allow them to be manufactured from a single extrusion form, while retaining the ability to be used with one or more differently sized gates.

18 Claims, 5 Drawing Sheets

MODULAR GUIDE FRAME FOR A GATE

BACKGROUND OF THE INVENTION

1. Field of the Invention

The present invention relates to guides for sliding gates and more particularly to a modular guide frame that may be easily adapted for use with gates having different or slightly irregular thicknesses.

2. Description of the Related Art

Simple mechanical gates, such as slide gates, stop gates and weir gates have been used for countless years in fields such as agriculture, municipal water systems, wastewater systems, and the like. Such systems are typically comprised of a single, planar gate that slides between open and closed positions within an elongated guide or channel, which is shaped to conform to the shape and size of the gate. These gates and their guides have been previously fabricated from numerous different materials, including wood, steel, galvanized steel, extruded aluminum, reinforced polymers, and the like. Clearly, one of the most common methods of fabricating such a system is to prepare a gate, having a particular size and shape, and then fabricating a gate guide to fit the gate. The gate guide may be provided in the form of one or more elongated, one-piece channels that may be cut to size and reconfigured into a particular shape that will slidably receive the gate. The gate guide may then be mechanically secured in position or imbedded within concrete or other suitable material, depending upon the particular application.

However, a problem frequently encountered in the assembly and installation of a gate system occurs when a gate is selected that has an uncommon or slightly irregular thickness. In these instances, pre-fabricated gate guide materials may provide a channel width that is too broad to provide an adequate sealing engagement between the gate and the gate guide, or the channel may be too narrow, preventing the gate from being received within the gate guide. In either situation, the installer is forced to custom fabricate a gate guide to adequately receive the gate, if a new gate, having standard dimensions cannot be used. Unfortunately, custom fabricating gate guides can be costly and time consuming. This is especially true in large-scale settings that require a plurality of gates having one or more unique gate sizes or configurations.

Accordingly, what is needed is a modular gate guide frame that may be fabricated using efficient, extrusion methods while being quickly and easily adapted for use with one or more gates having unusual or slightly irregular dimensions.

SUMMARY OF THE INVENTION

The gate guide frame of the present invention is preferably provided in a modular configuration, having separate first and second side portions. Each side portion is provided with elongated first and second wing members that extend outwardly from the rearward portion of a hub. Each hub is shaped to have at least to side faces that extend forwardly from the backsides of each hub. At least two mating faces extend inwardly from the distal ends of the side faces, forming a forward end portion for each hub. The mating surfaces are shaped and positioned so that the mating faces from opposing side portions may be operatively coupled with one another. Side faces from each hub combined to define the width of the channel that is formed when the two side portions are coupled with one another. In a preferred embodiment, the side faces of each hub are provided with different widths. Accordingly, the hubs from the opposing side portions may be selectively joined with one another in different configurations to provide a gate guide with one of various different widths.

Each side portion of the gate guide is provided with at least two wing members that extend along the length of the gate guide. The wing members are positioned with respect to the hub so that, depending upon the manner in which the opposing hubs are coupled with one another, one wing member from each side portion will combine to form a pair of spaced-apart frame rails, while the remaining wing members provide anchors for stabilizing the gate guide.

In one preferred embodiment, elongated channels are formed within the wing members. Resilient sealing members may be secured to the wing members within the elongated channels inside the spaced-apart frame rails, to provide a smooth sliding motion and a snug, sealing fit for the gate in a closed position.

It is therefore a principle object of the present invention to provide a modular guide frame for gates that may be easily adapted for gates having various thicknesses and configurations.

A further object of the present invention is to provide a modular guide frame for gates of various thicknesses that may be fabricated from a single extrusion form.

Still another object of the present invention is to provide a modular guide frame for gates that may be formed using a single pair of frame halves to form a guide channel having one of at least three different, pre-selected, channel widths.

Yet another object of the present invention is to provide a modular guide frame for a gate that is formed from a single pair of identically shaped frame halves and an optional expansion plate to easily accommodate at least four different, pre-selected gate widths.

A further object of the present invention is to provide a modular guide frame for gates that is relatively simple and inexpensive to manufacture.

Still another object of the present invention is to provide a modular guide frame for gates that may be easily adapted in the field for use with gates having a wide range of thicknesses and further provide the option of using resiliently deformable sealing members to engage the opposing surfaces of the gate as it moves between open and closed positions.

These and other objects will be apparent to those having skill in the relevant art.

DETAILED DESCRIPTION OF THE INVENTION

Figure 1:
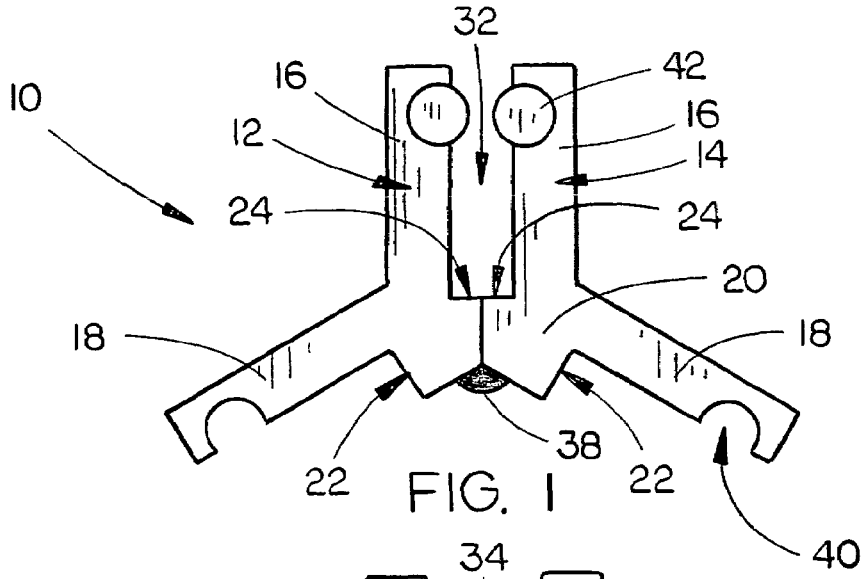
FIG. 1 is a front elevation view of one preferred embodiment of the modular guide frame of the present invention as the same could be assembled for use with a gate having a narrow thickness.

In the following detailed description of exemplary embodiments, reference is made to accompanying FIGS. 1-7, which form a part hereof and show, by way of illustration, exemplary embodiments of the present invention. These embodiments are disclosed in sufficient detail to enable those skilled in the art to practice the invention. It is to be understood that other embodiments may be utilized, however, and other changes may be made without departing from the spirit or scope of the present invention. The following detailed description is, therefore, not to be taken in a limiting sense in that the scope of the present invention is defined only by the appended claims.

The modular guide frame 10 of the present invention may be used with sliding gates of various shapes and sizes and in a wide array of different applications. In its preferred embodiment, the guide frame 10 is provided with a first side portion 12 and a second side portion 14. While it is contemplated that the first and second side portions 12 and 14 could be provided with various structural differences to accommodate specific applications, it is preferred that they be nearly identical in size and shape. Accordingly, both first and second side portions 12 and 14 are provided with a first wing member 16 and a second wing member 18 that extend outwardly from the rearward portion of a hub 20. The hubs 20 are each multi-facetted, being provided with at least a first side face 22 and a second side face 24 that extend forwardly from the rearward portions of each hub 20. Each hub is further provided with at least a first mating face 26 and a second mating face 28. As depicted in the accompanying figures, the first and second mating faces 26 and 28 should extend outwardly and inwardly from the distal end portions of the first and second side faces 22 and 24. While only two side faces and two mating faces are shown for each hub, it is contemplated that certain applications may permit the hubs 22 to have a geometry that utilizes additional side faces and/or mating faces to accommodate the needs of the particular applications.

Figure 2:
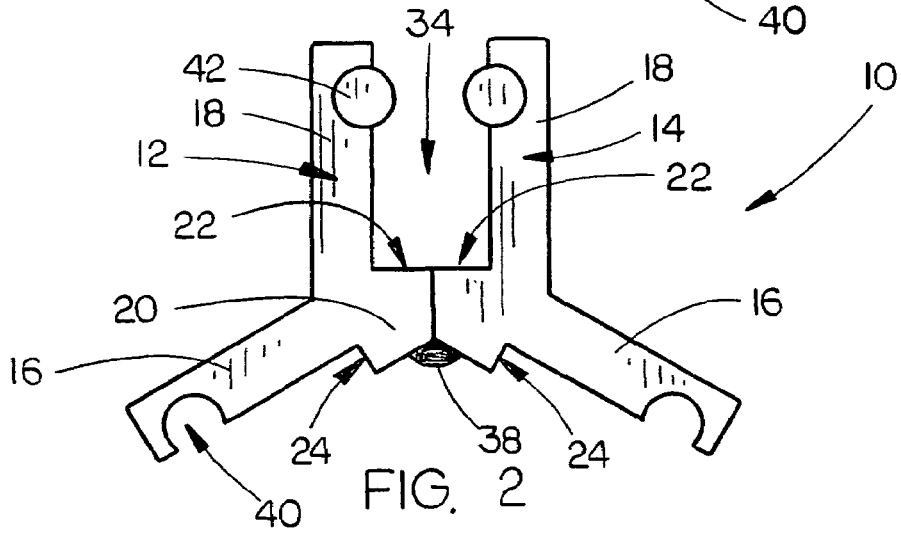
FIG. 2 is a front elevation view of the guide frame depicted in FIG. 1 as the same could be assembled for use with a gate having a large thickness.
Figure 3:
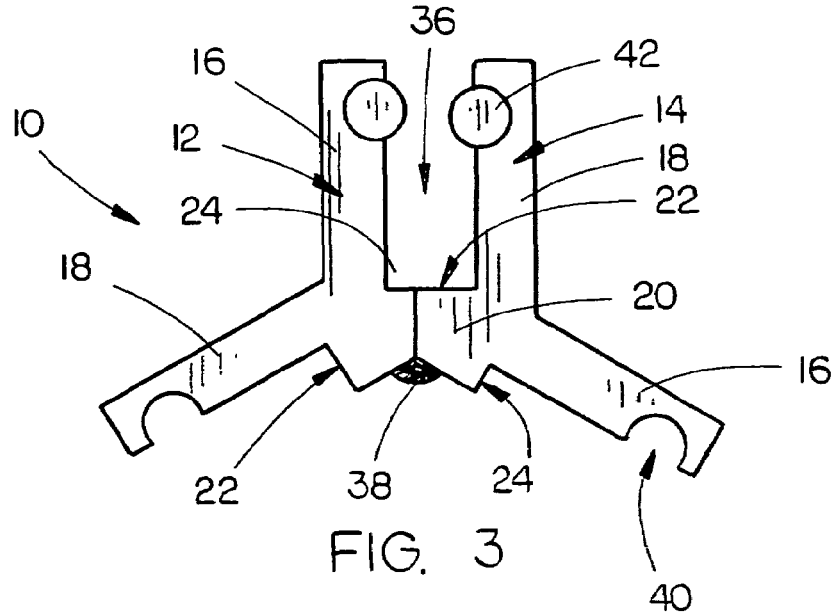
FIG. 3 is a front elevation view of the guide frame depicted in FIG. 1 as the same could be assembled for use with a gate having an intermediate thickness.

The first and second mating faces 26 and 28 on the hubs 20 are shaped and positioned so that they may be coupled with a first mating face 26 or second mating face 28 from an opposing hub 20 in various configurations, as depicted in FIGS. 1-3. While the first and second mating faces 26 and 28 are depicted as being flat, it is contemplated that textured, curved, keyed, or other specifically shaped faces could be provided to the first and second mating faces 26 and 28. Regardless of the shape selected, however, the shapes should be provided in a manner that is easily and securely matable with one another. The orientation of the first and second mating faces 26 and 28 should be such that one of the first and second side surfaces 22 and 24 on one hub 20 will align with either the first side surface 22 or the second side surface 24 of the opposing hub. While the side surfaces depicted in FIGS. 1-3 align with one another in a generally coplanar fashion, it is contemplated that the orientation may be angular with respect to one another, so long as the combining side faces form an operable base for the guide channel, which will slidably receive a gate 30.

In a preferred embodiment, the first and second side faces 22 and 24 on each hub 20 have different widths, one being shorter than the other. In this manner, when the first and second side faces 22 and 24 are coupled adjacent one another, a gate guide frame 10 may be provided having one of two or more different gate channel widths when the first side portion 12 and second side portion 14 are coupled with one another. For example, FIG. 1 depicts an instance where the second side surfaces 24 from two opposing hubs 20 are coupled adjacent one another to form a narrow gate channel 32. FIG. 2 depicts an arrangement where the first side portion 12 and second side portion 14 are coupled with one another in a manner that places the first side surfaces 22 of both hubs 20 adjacent one another. This arrangement produces a wide gate channel 34. FIG. 3, on the other hand, depicts an arrangement where the first side portion 12 and second side portion 14 are arranged with respect to one another so that a first side surface 22 and second side surface 24 are positioned adjacent one another, forming an intermediate width gate channel 36.

Figure 4:
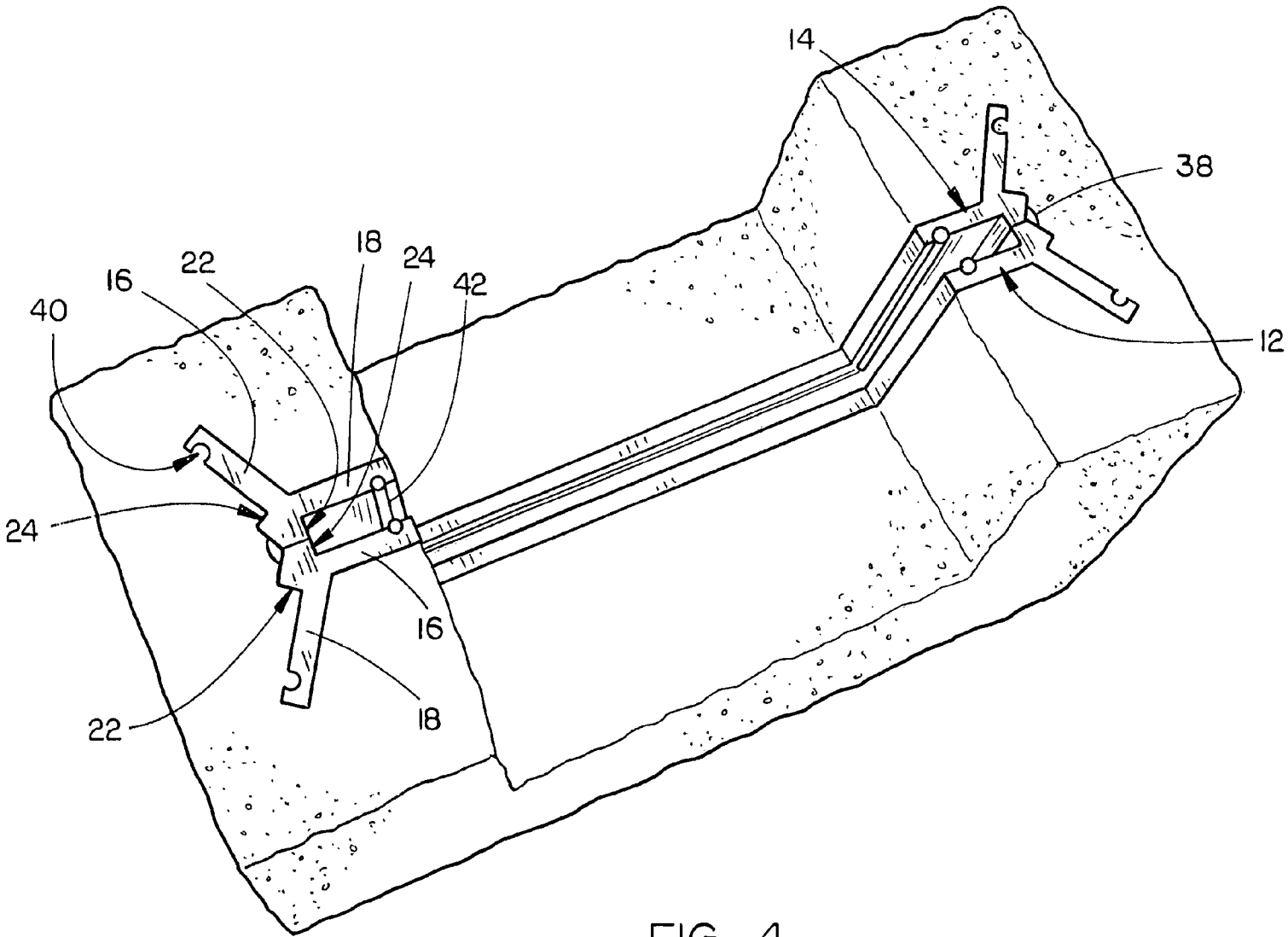
FIG. 4 is an isometric view of one manner in which the modular guide frame of the present invention could be assembled for use with a gate in a fluid passageway.
Figure 5:
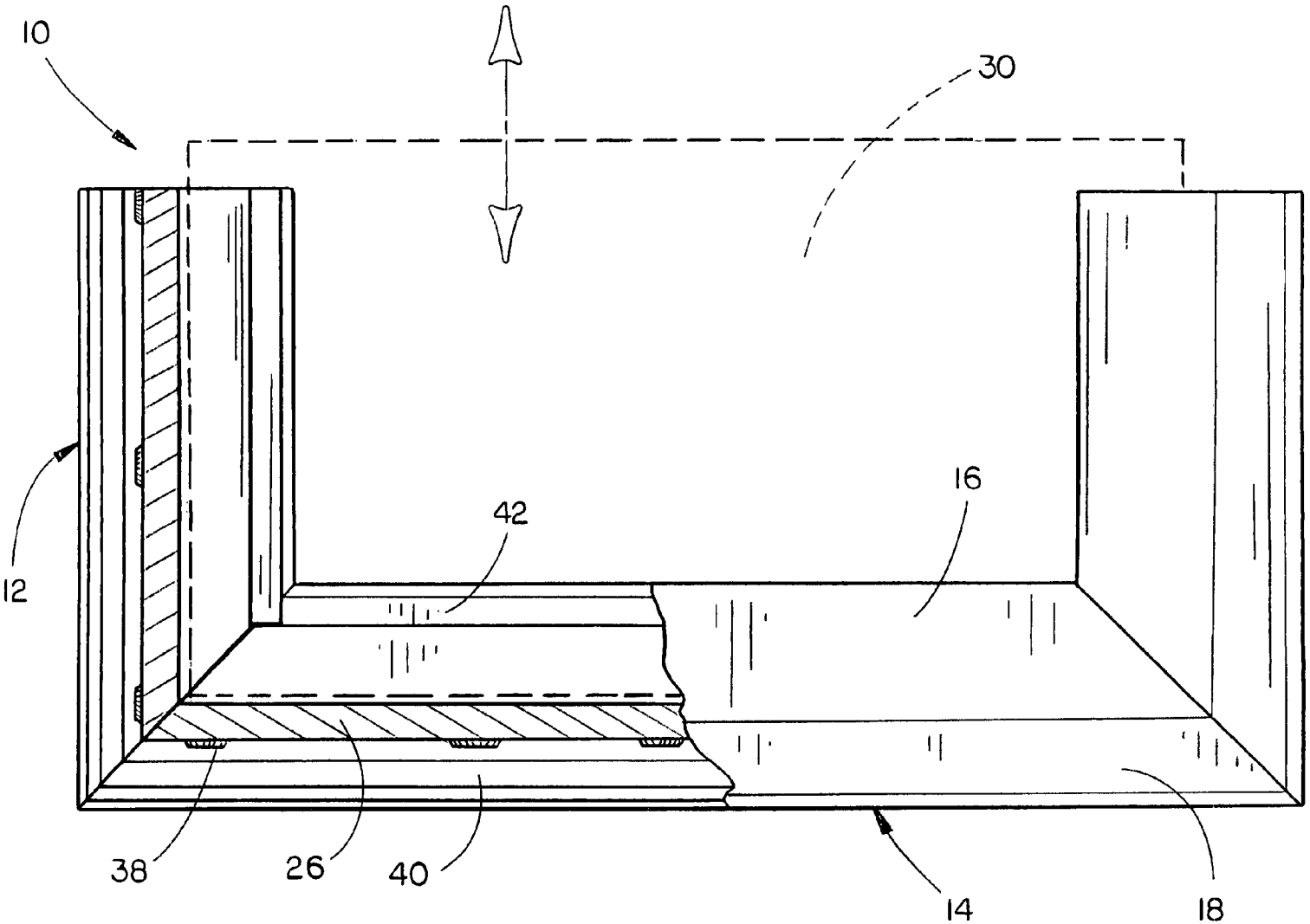
FIG. 5 is a sectional, side elevation view of one preferred embodiment of the modular guide frame of the present invention as the same could be configured to slidably receive a gate.

FIG. 4 depicts one contemplated arrangement of the modular guide frame 10, as the same could be provided to slidably receive a gate. This figure demonstrates the fact that a single section of modular guide frame can first be cut into a first side portion 12 and a second side portion 14 and then cut again into a plurality of pieces so that the first and second side portions 12 and 14 may be arranged in the desired configuration, such as the rectangular passageway depicted in FIG. 4. While the guide frame 10 is depicted in FIG. 4 as being imbedded within a solid material, such as concrete, other known materials are contemplated into which the components of the guide frame 10 may be imbedded. Moreover, it is contemplated that certain applications may permit the guide frame 10 to be mounted to a surface using one or more mechanical fasteners. Irrespective of its final form, it may be advantageous to first join the first side portions 12 and second side portions 14 so that the side portions do not move with respect to one another when one or more sections are being installed. Depending upon the materials selected to fabricate the guide frame 10, various adhesives, structural fasteners, and methods of welding, such as the spot welds 38 are contemplated. The guide frame 10 may be formed from nearly any material that will withstand the operating environment of the desired application. Examples of such materials may include, but will certainly not be limited to steel, galvanized steel, wood, reinforced polymers and the like. However, certain extrusion processes and materials, such as those used to manufacture extruded aluminum, may be highly desirable due to the strength and lightweight of the material and the ease in which it may be mass produced from a single form.

In one preferred embodiment, elongated channels 40 are formed along the lengths of at least one side of the first wing members 16 and second wing members 18. The channels 40 should be sized and shaped to securably receive elongated sealing members 42. The sealing members 42 should extend outwardly from the channels 40 so that, when the channels 40 are disposed along inner walls of generally parallel, spaced-apart frame rails formed by either the first wing members 16 or second wing members 18, a portion of the sealing members 42 will slidably engage the outer surfaces of a gate 30 as it is moved between open and closed positions. In a preferred embodiment, the sealing members are formed to have a generally curved cross section, such that the portion that engages a surface of the gate 30 will present few, if any flat surfaces or corners that may be exposed to and snagged by edge portions of the gate 30. However, it is contemplated that the sealing members 42 can be provided in a wide variety of shapes, having curved features, flat features, or a combination of the two. The deformably resilient nature of the material used in forming the sealing members 42 will further accommodate the fit of a gate 30 having a thickness that is slightly more or less than desirable for the channel width provided. Moreover, the sealing engagement between the sealing members 42 and the gate 30 will help to inhibit the passage of fluids between the guide frame 10 and the gate 30. Although several natural and synthetic materials, such as rubber and certain closed cell foam products, an ultra high-molecular weight (UHMW) polymer will be preferred due to its ability to minimize friction between the gate 30 and the sealing members 42, which will ultimately reduce the operating force required to move the gate 30 between open and closed positions.

Figure 6:
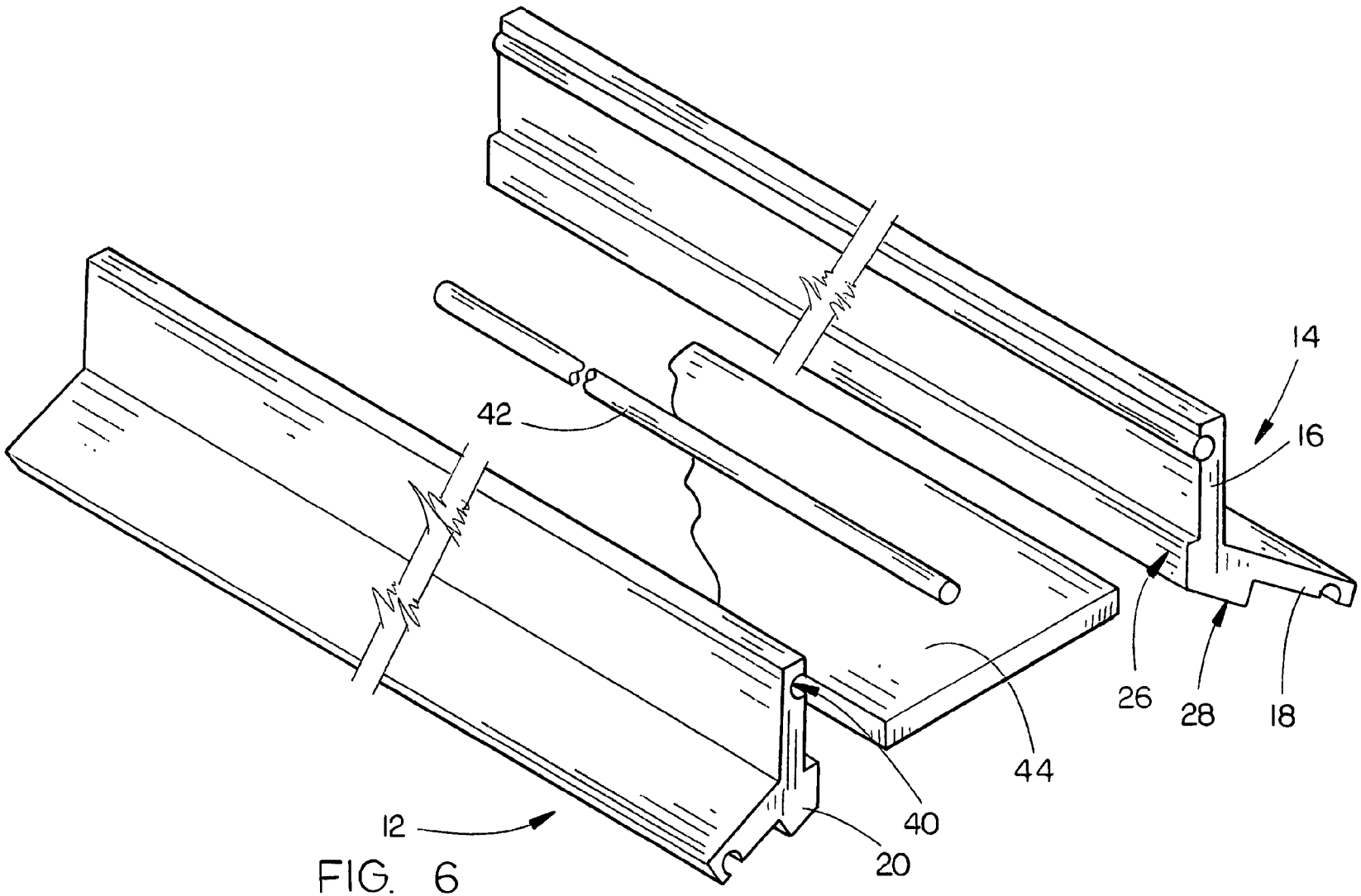
FIG. 6 is an exploded isometric view of still another embodiment of the modular guide frame of the present invention.
Figure 7:
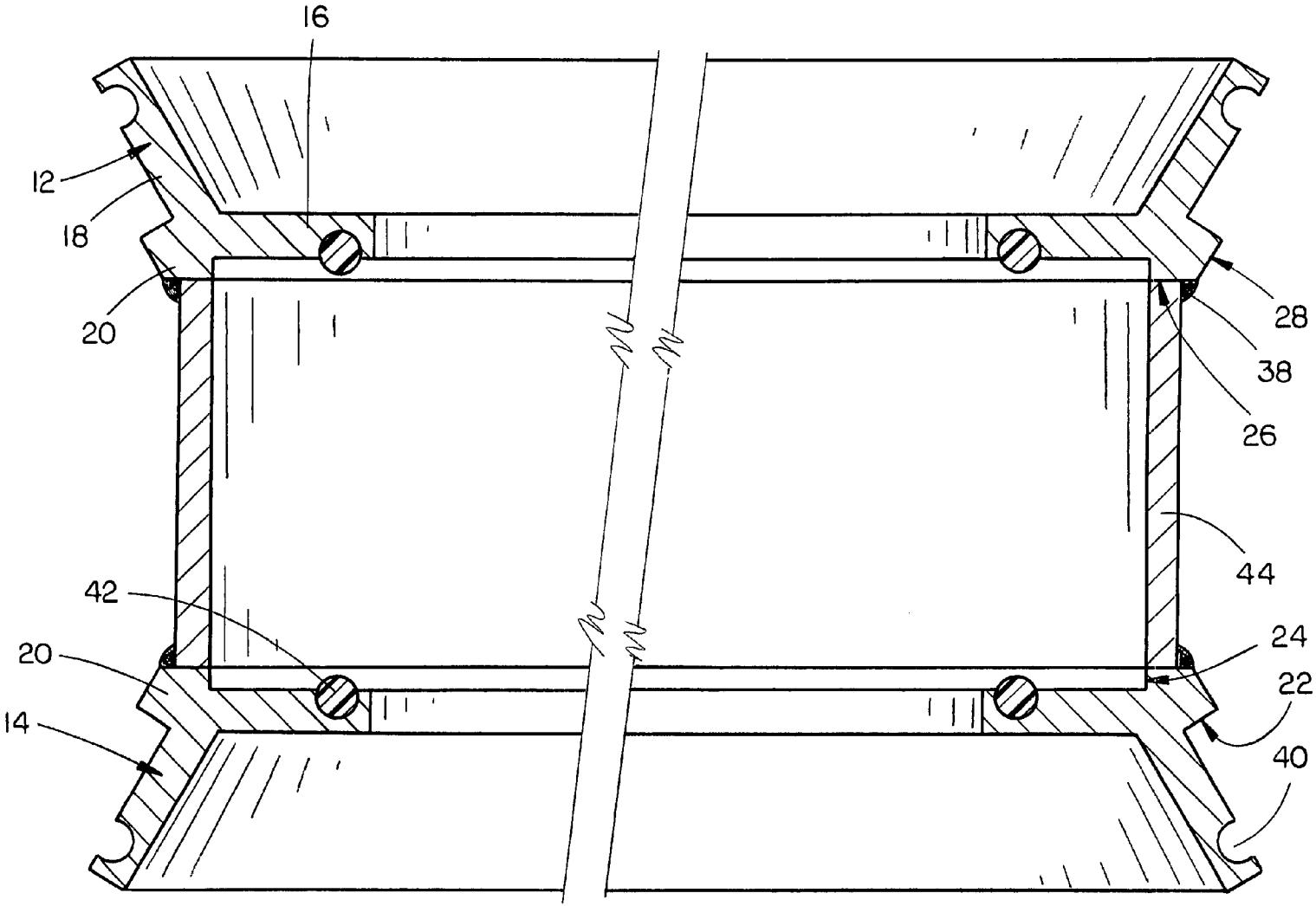
FIG. 7 is a top, section view of the guide frame depicted in FIG. 6 as the same could be assembled for use with a relatively wide gate.

Another preferred embodiment of the modular guide frame 10 is depicted in FIGS. 6 and 7. These figures demonstrate the use of an extension plate 44 that has a width which extends between opposite side portions. The opposite side portions of the extension plate 44 are preferably sized and shaped to engage either of the first or second mating faces 26 and 28 on either of the first side portion 12 or second side portion 14. An extension plate 44 may be provided with a specific width and used with the first and second side portions 12 and 14 to provide a guide frame 10 for use with gates having a substantial thickness. Accordingly, extension plates 44 may be provided in several different widths or cut to length and width in the field to accommodate gates of various dimensions. As with the previously described embodiments, one of the first and second side surfaces 22 and 24 from each of the first and second side portions 12 and 14 will align with a surface of the extension plate 44 to provide a channel base for the guide frame 10. While the channel base depicted in the figures is generally coplanar, it is contemplated that curved or angled variations may be provided to accommodate particular applications.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A modular guide frame for a gate, comprising:

a first side portion, having elongated first and second wing members extending outwardly from a rearward portion of a first hub; said first hub having at least first and second side faces extending forwardly from said rearward portion and first and second mating faces that extend outwardly and inwardly from distal end portions of said first and second side faces; and a second side portion, having elongated first and second wing members extending outwardly from a rearward portion of a second hub; said second hub having at least first and second side faces extending forwardly from said rearward portion and first and second mating faces that extend outwardly and inwardly from distal end portions of said first and second side faces;

said first and second mating faces on said first hub being shaped and positioned so that they may be operatively coupled with the first and second mating faces on said second hub in a manner that aligns one of the first and second side faces of said first hub with one of the first and second side faces of said second hub to form a channel base for the guide frame.

2. The guide frame of claim 1 wherein the first side face of said first hub extends in a generally perpendicular fashion from the first wing member of said first side portion and the second side face of said first hub extends in a generally perpendicular fashion from the second wing member of said first side portion.

3. The guide frame of claim 2 wherein the first side face of said second hub extends in a generally perpendicular fashion from the first wing member of said second side portion and the second side face of said second hub extends in a generally perpendicular fashion form the second wing member of said second side portion.

4. The guide frame of claim 2 wherein the first and second side faces of said first hub have different widths so that a gate guide having one of at least two different gate channel widths may be formed when said first and second side portions are coupled with one another.

5. The guide frame of claim 4 wherein the first and second side faces of said second hub have different widths so that a gate guide having one of at least three different gate channel widths may be formed when said first and second side portions are coupled with one another.

6. The guide frame of claim 1 further comprising an elongated extension plate, having a width that extends between opposite side portions; said opposite side portions being shaped to be coupled with the first or second mating surfaces on said first and second hubs in a manner that aligns one of the first and second side faces of said first hub, an upper surface of said extension plate, and one of the first and second side faces of said second hub to from a channel base for the guide frame.

7. The guide frame of claim 1 wherein said first and second side portions are shaped so that one of said first and second wing members from said first side portion and one of said first and second wing members from said second side portion form generally parallel, spaced-apart frame rails when said first and second side portions are operatively coupled with one another.

8. The guide frame of claim 7 wherein said first and second side portions are shaped so that one of said first and second wing members from said first side portion and one of said first and second wing members from said second side portion form a pair of spaced-apart anchors that extend outwardly from said frame rails when said first and second side portions are operatively coupled with one another.

9. The guide frame of claim 8 wherein said anchors extend outwardly and in generally rearward directions from said frame rails when said first and second side portions are operatively coupled with one another.

10. The guide frame of claim 8 wherein said first and second wing members on said first side portion and said first and second wing members on said second side portion are provided with generally elongated channels that extend along lengths of said first and second wing members so that at least a pair of said channels are positioned on opposing inner surfaces of said frame rails when said first and second side portions are operatively coupled with one another.

11. The guide frame of claim 10 further comprising at least a pair of elongated, deformably resilient sealing members that are securably disposed within said channels on said opposing inner surfaces of said frame rails when said first and second side portions are operatively coupled with one another.

12. The guide frame of claim 1 wherein the first and second side faces of said first hub have different widths so that a gate guide having one of at least two different gate channel widths may be formed when said first and second side portions are coupled with one another.

13. The guide frame of claim 12 wherein the first and second side faces of said second hub have different widths so that a gate guide having one of at least three different gate channel widths may be formed when said first and second side portions are coupled with one another.

14. The guide frame of claim 12 further comprising an elongated extension plate, having a width that extends between opposite side portions; said opposite side portions being shaped to be coupled with the first or second mating surfaces on said first and second hubs in a manner that aligns one of the first and second side faces of said first hub, an upper surface of said extension plate, and one of the first and second side faces of said second hub to form a channel base for the guide frame.

15. The guide frame of claim 12 wherein said first and second side portions are so that one of said first and second wing members from said first side portion and one of said first and second wing members from said second side portion form generally parallel, spaced-apart frame rails when said first and second side portions are operatively coupled with one another.

16. The guide frame of claim 15 wherein said first and second side portions are shaped so that one of said first and second wing members from said first side portion and one of said first and second wing members from said second side portion form a pair of spaced-apart anchors that extends outwardly from said frame rails when said first and second side portions are operatively coupled with one another.

17. The guide frame of claim 15 wherein said first and second wing members on said first side portion and said first and second wing members on said second side portion are provided with generally elongated channels that extend along lengths of said first and second wing members so that at least a pair of said channels are positioned on opposing inner surfaces of said frame rails when said first and second side portions are operatively coupled with one another.

18. The guide frame of claim 17 further comprising at least a pair of elongated, deformably resilient sealing members that are securably disposed within said channels on said opposing inner surfaces of said frame rails when said first and second side portions are operatively coupled with one another.

* * * * *